United States Patent [19]

Lenting

[11] Patent Number: 4,934,021

[45] Date of Patent: Jun. 19, 1990

[54] VACUUM CLEANING WATER SEPARATOR

[75] Inventor: Gerard J. Lenting, Groningen, Netherlands

[73] Assignee: U.S. Philips Corp., New York, N.Y.

[21] Appl. No.: 279,386

[22] Filed: Dec. 2, 1988

[30] Foreign Application Priority Data

Dec. 16, 1987 [NL] Netherlands ..... 8703038

[51] Int. Cl.[5] ..... A47L 7/00

[52] U.S. Cl. ..... 15/353; 55/216

[58] Field of Search ..... 15/353; 55/215, 216

[56] References Cited

U.S. PATENT DOCUMENTS

| | | | |
|---|---|---|---|
| 2,212,429 | 8/1940 | Yutzler | 55/462 X |
| 3,048,875 | 8/1962 | Bottinelli et al. | 15/353 X |
| 3,074,217 | 1/1963 | Sheps et al. | 55/216 |
| 3,173,164 | 3/1965 | Congdon | 55/216 X |
| 4,821,367 | 4/1989 | McAllister et al. | 15/353 |

FOREIGN PATENT DOCUMENTS

| | | | |
|---|---|---|---|
| 1054759 | 5/1979 | Canada | 15/353 |

*Primary Examiner*—Chris K. Moore

*Attorney, Agent, or Firm*—Ernestine C. Barlett

[57] ABSTRACT

Vacuum cleaning water separator for a vacuum cleaner including a receptacle (1) having a cover (2), and a closing mechanism (7) comprising a float operable valve (10) to seal-off a suction channel (8) when the receptacle is filled to a predetermined level, characterized in that the valve (10) is rotatably supported in the cover (2), the closing mechanism (6) includes a lever (12) which is rotatably supported in the cover and is coupled to the float (9), the valve being locked by the lever (12) in an open state at an extreme position of the float, travel of the float (9) unlocking the valve (10).

7 Claims, 2 Drawing Sheets

VACUUM CLEANING WATER SEPARATOR

FIELD OF THE INVENTION

The invention relates to a vacuum cleaning water separator for a vacuum cleaner, including a receptacle having a cover, the cover comprising a first connection member for a vacuum cleaner, a second connection member for a suction nozzle and a closing mechanism comprising a float-operable valve providing a seal between a suction channel and a first connection when the receptacle is filled to a predetermined level.

Such a vacuum cleaning water separator is disclosed in U.S. Pat. No. 2,649,927. In said separator, the float and the valve are rigidly interconnected by means of a piston rod. Depending on the rising water level in the receptacle the valve will only slowly shut-off the suction channel.

SUMMARY OF THE INVENTION

The invention has for its object to provide an improvement of the vacuum cleaning water separator defined in the opening paragraph.

According to the invention, the vacuum cleaning water separator is characterized in that the valve is rotatably supported in the cover and the closing mechanism includes a lever which is rotatably supported in the cover and coupled to the float, the valve being locked by the lever in an open state at an extreme position of the float, travel of the float effecting unlocking of the valve.

Under normal circumstances, during suction of the water, a force will be exercised on the lever of the closing mechanism by the weight of the float, causing the lever to lock the valve in its open state. As soon as the float moves somewhat, the lever is also moved somewhat, as a result of which an opposing force of the valve pushes the lever further away, the valve is unlocked and seals-off the suction channel. The force exercised on the float not only decreases in response to the upward force of the rising water in the receptacle, but also when the separator falls over, whatever the reason, the weight of the float then no longer exercises any substantial force on the lever. Consequently, the closing mechanism also acts as a safety device should the separator topple over.

The opposing force of the valve can be produced by a spring. In a preferred embodiment, when the vacuum cleaner is switched-on, a suction force is exercised on the valve and, when unlocked, the valve seals-off the suction channel. This has the additional advantage that after switch-off of the vacuum cleaner the valve automatically returns to the open state by its own weight.

The vacuum cleaning water separator can be coupled to a vacuum cleaner tube in the position where usually the suction nozzle is provided. The vacuum cleaning water separator is consequently subjected to a reciprocal motion, since unlocking of the valve is caused by a slight travel of the float from its extreme position, it is necessary to ensure that the float does not make any undesired movements. To that end, the closing mechanism of the vacuum cleaning water separator is accommodated in a housing, a bottom of the housing being provided with a recessed portion and a portion of the recess being designed as a chamber for the float thereby shielding the float from the splashing water in the receptacle and preventing unlocking of the valve when such is unwanted.

In a further embodiment of the said vacuum cleaning water separator, a portion of the housing bottom recess is designed as a water separating grating, constituted by a plurality of slits in the side walls and the bottom of the recess, the longitudinal direction of the slits in the bottom extending in the direction of travel of the water separator and the slits being in a vertical position in the side walls. A mixture of water and air is sucked towards the grating. At the grating, the air is deflected towards the suction channel. The slits are directed such that due to hitting the grating, the water loses its velocity and falls back. The grating consequently produces a separation between water and air.

The separator can alternatively be used for sucking coarse dirt. For that purpose the separating grating can be covered by a removable filter structure.

To prevent a difference in pressure in the water receptacle across the housing of the separating grating, the housing is provided with at least one pressure equalizing channel.

To allow cleaning, the housing is fitted detachably in the cover.

BRIEF DESCRIPTION OF THE DRAWING

The invention will now be described in greater detail by way of non-limitative example with reference to an embodiment shown in the accompanying drawing.

Figure 1:
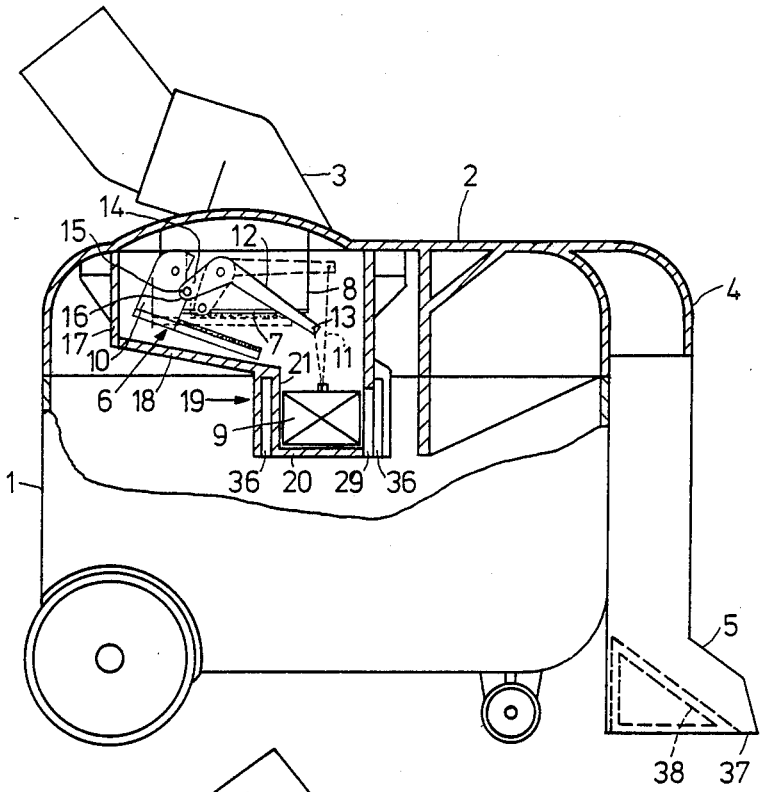
FIG. 1 is a cross-sectional view through the center of the water separator.
Figure 2:
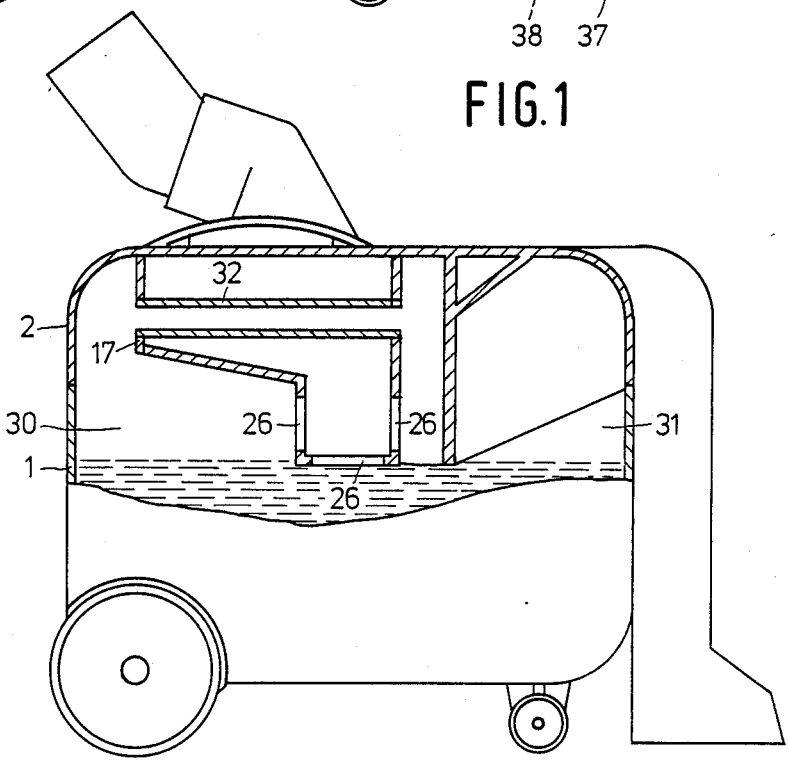
FIG. 2 is a different cross-sectional view of the water separator.

The vacuum cleaning water separator is formed by a movable receptacle which at its upper side is closed by a cover 2. The cover 2 comprises a connection member 3 for connection to a vacuum cleaner, not shown, preferably by means of a suction pipe of a vacuum cleaner, and a different connection member 4 to which a suction nozzle 5 can be connected. The cover 2 is further provided with a closing mechanism 6, by means of which an aperture 7 of a suction channel 8 to the connection member 3 can be opened or closed. The closing mechanism comprises a float 9 and a valve 10 which is rotatably supported in the cover. The float is connected to the valve 10 by means of a float rod 11 and a lever 12. The lever 12 is rotatably supported in the cover, one end 13 of the lever being connected to the float rod and the other end 14 having a contact pin 15 for cooperation with a curved locking plane 16 of the valve 10.

Figure 3:
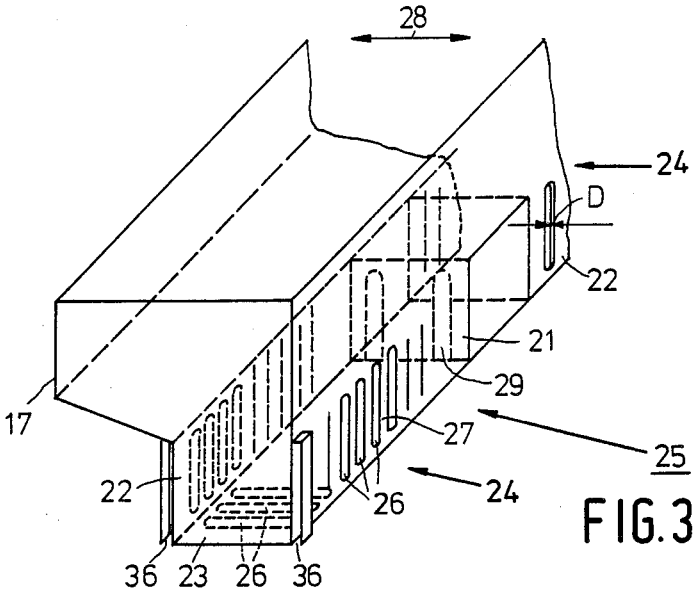
FIG. 3 is an elevational view of the separating grating.
Figure 4:
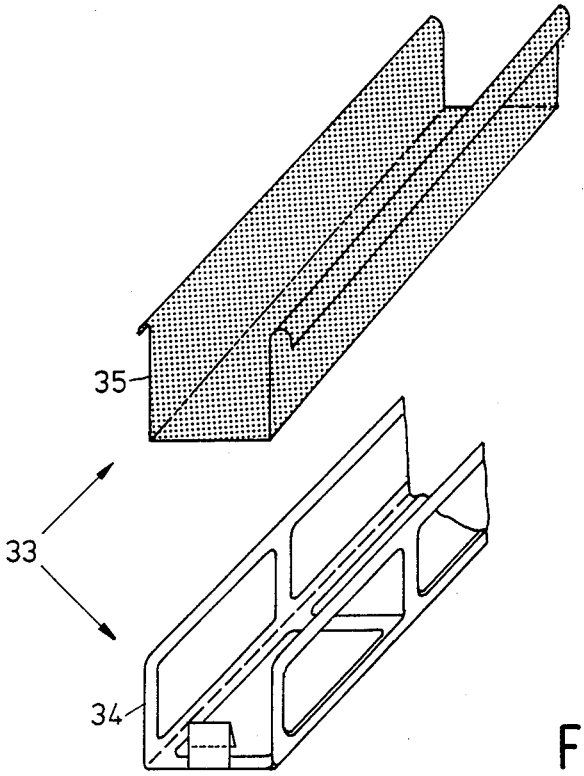
FIG. 4 shows a filter structure for the separating grating.

The closing mechanism 6 is accommodated in an enveloping housing 17. A recess 19 is provided in a bottom 18 of the housing, a central portion 20 of the recess being designed as a chamber 21 for the float 9 (see FIG. 3). The side walls 22 and the bottom 23 of the further portions 24 on both sides of the float chamber 21 are designed as a water separating grating 25. This grating is formed by a large number of slits 26 in the side walls 22 and the bottom 23. The bars 27 between the slits (i.e. the wall thickness) have a thickness D of not less than 2 mm. The slits in the bottom 23 of the recess have their longitudinal direction extend in the direction of operative travel 28 of the water separator, while the slits in the side walls 22 extend vertically. During operation, a mixture of air and water is sucked into the receptacle. The separating grating then operates to separate the water and the air from each other. Water and air arrive at a given rate at the grating. The sucked air is deflected vertically and sucked to the suction channel 8. Due to its collision with the grating, the water loses so much of its speed that because of its greater mass it cannot follow the air flow and falls back. The housing 17 is fitted detachably in the cover 2 by means of a known snap-on connection with projections and recesses. The float chamber 21 is located approximately in the center of the receptacle, since in that region the splashing water is at its lowest point. The float chamber has a water inlet aperture 29.

The closing mechanism operates as follows: when no suction force is exercised, the valve 10 falls down to an open state by its own weight. The weight of the float 9 exercises a force on the lever end 13, in response to which the lever end 13 wants to turn to the right. The vacuum cleaner being in the switch-on state, suction force which tends to draw the valve in the direction of the aperture 7 of the suction channel 8 (to the left) is continuously exercised on the valve 10. This is however prevented by the fact that the contact pin 15 of the lever end 14 pushes against the locking plane 16 of the valve 10 and consequently locks the valve.

If now, caused by the rising water level in the receptacle 1, the float 9 travels upwards from its lowest position, the force exercised by the lever end 14 on the valve will become less than the force exercised by the valve on the lever and produced by the suction force. This causes the contact pin 15 of the lever to slide along the locking plane 16 of the valve and the valve is unlocked, causing it to turn to the suction channel 8 under the influence of the suction force and to keep the aperture sealed until the suction force is switched off. After the suction force has disappeared (the vacuum cleaner is switched-off) the valve returns to the open state because of its own weight. It will be obvious that the shape of the locking plane 16 and of the pin 15 co-operating therewith depend on the mass and dimensions of the relevant components and on the suction force.

The closing mechanism 6 also effects closure of the valve if the water separator falls over, so that under these circumstances no water can be sucked into the suction channel and further into the vacuum cleaner. As soon as the water separator falls over, the force exercised by the float 9 on the lever 11, which force is necessary to lock the valve, becomes too small, so that the valve pushes the lever aside under the influence of the suction force, the valve is blocked, and the aperture 7 is closed. Consequently, the closing mechanism also acts as a protection against falling or toppling of the water separator.

If the housing 17 extends in its totality to the side walls of the receptacle, it is possible that at a given instant when the water rises above the bottom side of the float chamber a pressure difference is produced in the receptacle across the casing 17, that is to say before and behind the housing. The water level will be higher in the space 30 than in the space 31 as a result of which unwanted effects may occur. To prevent this, one or a plurality of pressure equalizing channels 32 are provided transversely through the housing 17.

It is alternatively possible to suck-up coarse dirt with the vacuum cleaning water separator. To enable this, the water separating grating 25 is covered by a filter structure 33, constituted by a filter holder 34 in which a paper filter 35 is placed. The filter holder 34 with paper filter 35 is slid into recesses 36 in the walls 22 of the recessed portion 19, the paper filter covering the slits 26 in the walls of the recess.

If the water separator is used for sucking-up coarse dirt, the aperture of the suction nozzle 5 must be increased. For that purpose the suction nozzle aperture 37 is provided with a detachable insert 38. To allow vacuum cleaning of coarse dirt, this insert must be removed from the suction nozzle aperture. When the separator is used for vacuuming water, the suction nozzle aperture must be reduced such that water can be vacuumed.

What is claimed is:

1. A vacuum cleaning water separator, including a receptacle having a cover, the cover comprising a first connection member for a vacuum cleaner, a second connection member for a suction nozzle and a closing mechanism comprising a float-operable valve to provide a seal between a suction channel and a first connection when the receptacle is filled to a predetermined level, wherein the valve is rotatably supported in the cover, the closing mechanism includes a lever which is rotatably supported in the cover and is coupled to the float, the valve being locked by the lever in an open state at an extreme position of the float, travel of the float effecting unlocking of the valve.

2. A vacuum cleaning water separator as claimed in claim 1, wherein the vacuum cleaner is in the switched-on position and during suction of water up to a predetermined level, a suction force is exerted on the valve and, on un-locking, the valve closes the suction channel.

3. A vacuum cleaning water separator including a receptacle having a cover, the cover comprising a first connection member for a vacuum cleaner, a second connection member for a suction nozzle and a closing mechanism comprising a float-operable valve to provide a seal between a suction channel and a first connection when the receptacle is filled to a predetermined level, wherein the valve is rotatably supported in the cover;

the closing mechanism includes a lever which is rotatably supported in the cover and is coupled to a float, the closing mechanism being in a housing comprising sidewalls and a bottom wall, the bottom wall having a recess and a portion of the recess comprises a float chamber for the float;

the valve being locked by the lever in an open state at an extreme position of the float, travel of the float effecting unlocking of the valve.

4. A vacuum cleaning water separator as claimed in claim 3, wherein the remaining portion of the recess is a water separating grating having slits in the side walls and bottom of the recess.

5. A vacuum cleaning water separator as claimed in claim 4, wherein the separating grating can be covered by a detachable filter construction.

6. A vacuum cleaning water separator as claimed in claim 4, wherein at least one pressure equalizing channel is provided transversely through the housing to prevent a difference in pressure in the water receptacle across the housing of the separating grating.

7. A vacuum cleaning water separator as claimed in claim 3, wherein the housing is fitted detachably in the cover.

* * * * *